United States Patent [19]

Anderson

[11] 4,369,827

[45] Jan. 25, 1983

[54] WINDOW SHADE SEALING SYSTEM

[76] Inventor: Alan A. Anderson, 6701 Seybold Rd., Madison, Wis. 53719

[21] Appl. No.: 255,165

[22] Filed: Apr. 17, 1981

[51] Int. Cl.[3] ..... E06B 7/16

[52] U.S. Cl. ..... 160/41; 160/269

[58] Field of Search ..... 160/23 R, 41, 268, 269, 160/270

[56] References Cited

U.S. PATENT DOCUMENTS

| | | | |
|---|---|---|---|
| 341,334 | 5/1886 | King | 160/41 |
| 2,354,489 | 7/1944 | Tucker | 160/41 |
| 2,709,488 | 5/1955 | Lorentzen | 160/176 |
| 3,363,666 | 1/1968 | Hodgson et al. | 160/23 R |
| 4,244,417 | 1/1981 | Taylor | 160/243 |
| 4,258,517 | 3/1981 | Hammond | 160/269 |

*Primary Examiner*—Peter M. Caun

*Attorney, Agent, or Firm*—Isaksen, Lathrop, Esch, Hart & Clark

[57] ABSTRACT

A window covering sealing structure (10) adapted to seal a rollable window covering (30) having a flexible covering member (32) with a side edge (33) to a window frame (12). The window covering sealing structure (10) has strips (36) of a flexible, resilient sheet material adapted to be folded back on itself into a folded configuration having a longitudinally extending fold (38). The window covering sealing structure (10) also includes means for retaining the strips (36) in the folded configuration and for fastening the strips (36) to selected surfaces (26) of the window frame (12) with the fold (38) extending over the side edges (33) of the window covering to hold the side edges (33) thereunder against the frame (12) in sealing relation.

23 Claims, 5 Drawing Figures

WINDOW SHADE SEALING SYSTEM

TECHNICAL FIELD

The present invention relates to window coverings in general and, in particular, to means for sealing the edges of a rollable window covering to interrupt convection currents and other airflow about the window covering or to exclude light or insects.

BACKGROUND ART

The prior art is generally cognizant of conventional window coverings in which a roll of material is mounted at the top of the window so that the material may be unrolled and pulled down to cover the window. When the purpose of the window covering simply is to exclude a part of the light passing through the window, it is customary to make no attempt to seal or secure the window covering to the window or to the window frame. When an attempt is made to more completely seal the window, various structures have been utilized to contact and secure the vertical edges of the window covering.

Typical of the prior art is Smith, U.S. Pat. No. 1,142,918, in which a structure is provided to secure the edges of a rollable screen for the prevention of the passage of insects. The screen is stiffened with horizontally disposed metal rods having knobs at their ends. The knobs and the vertical edges of the screen slide downwardly through a rigid, metal track adapted to guide the edge of the screen and to retain the knobs, sealing the screen within the track. Kaletay, U.S. Pat. No. 2,084,847, provides a rigid track adapted to be squeezed down upon the edges of a rollable window insect screen. The screen is first pulled down into place, passing along a vertical, metal slot, and then a lever and cam device is used to squeeze the opposing parts of the slot together to grasp the screen. In Morse, U.S. Pat. No. 2,548,041, a spring-loaded, rigid hinge member is adapted to press the edges of material drawn over the window against an opposing metal surface, again to create a clamping effect.

Helgoth, U.S. Pat. No. 2,314,784, and Spencer, U.S. Pat. No. 2,564,770 both show elastic strips of metal or other suitable material adapted to press the vertical edges of window shades against a part of the frame of the window, so as to seal or secure them. Klaenhammer et al., U.S. Pat. No. 4,079,772, provides for the sealing of the sides and bottom of the window shade by the securing of a magnetized strip to the window frame and a corresponding ferromagnetic sealing strip to the shade. Moriarty et al., U.S. Pat. No. 4,126,174, shows a flexible sheet, roll up window covering having a vertical rib along each side of the sheet. The rib is guided between and held by opposed surfaces of a rigid seal guide strip mounted to the window frame. A transverse sealing pad extends across the top of the window frame and contacts the sheet material used to cover the window so as to provide a seal therebetween.

The window shade sealing mechanisms of the prior art require relatively long, rigid members that are inconvenient to ship or store during the marketing of such devices. Furthermore, complicated and relatively expensive fabrication often must be employed to make the extruded or folded metal and plastic parts utilized to guide or grasp the sides of a window covering. A facility with tools, and especially with saws or other means for cutting rigid materials is required in the installer of the prior art devices, who most cut various channels and guides made from such materials to fit the size of the window to be sealed. Alternatively, the provider of such materials must keep a wide variety of sizes in stock. In addition, with many of the prior art structures, the exact size and especially the width of the window covering is critical to the successful operation of the sealing device. Similarly, the size of the top sealing pad of Moriarty is critical to the success of the device shown.

DISCLOSURE OF THE INVENTION

The present invention is summarized in that a window covering sealing structure is adapted to seal a rollable window covering having substantially vertically extending edges to a window frame. The window covering sealing structure includes a longitudinally extended strip of flexible, resilient sheet material having a face and a longitudinal axis and adapted to be bent back on itself with a portion of the face substantially opposed to other portions of the face to form a longitudinally extending fold. The window covering sealing structure includes means for retaining the strip in the folded configuration and means for fastening a part of the strip remote from the fold to a selected part of the window frame to receive and hold one of the vertically extending edges of the window frame under the fold, whereby the edge is sealed to the window frame.

A primary object of the invention is to provide a means for impeding the flow of air around the edges of a window covering to thereby reduce the exchange of heat between the inside and outside of the building containing the window.

A second object of the invention is to provide for a window covering sealing structure that may be compactly packaged for shipping and sale.

A further object of the invention is to provide a window covering sealing structure that can be conveniently and easily cut to size without the requirement of wood, rigid plastic, or metal working tools, so that the average user can easily fit the sealing structure to his window.

Yet another object of the invention is to provide a single window covering sealing structure that can be applied in selected ways so as to harmonize in color either with dark or light colored woodwork.

Another object of the invention is to provide a window covering sealing structure thay may be manufactured inexpensively without complex tooling.

Other objects, feature, and advantages of the invention will be apparent from the following detailed description taken in conjunction with the accompanying drawings showing a preferred embodiment of a window covering sealing structure made in accord with the invention.

BEST MODE FOR CARRYING OUT THE INVENTION

Figure 1:
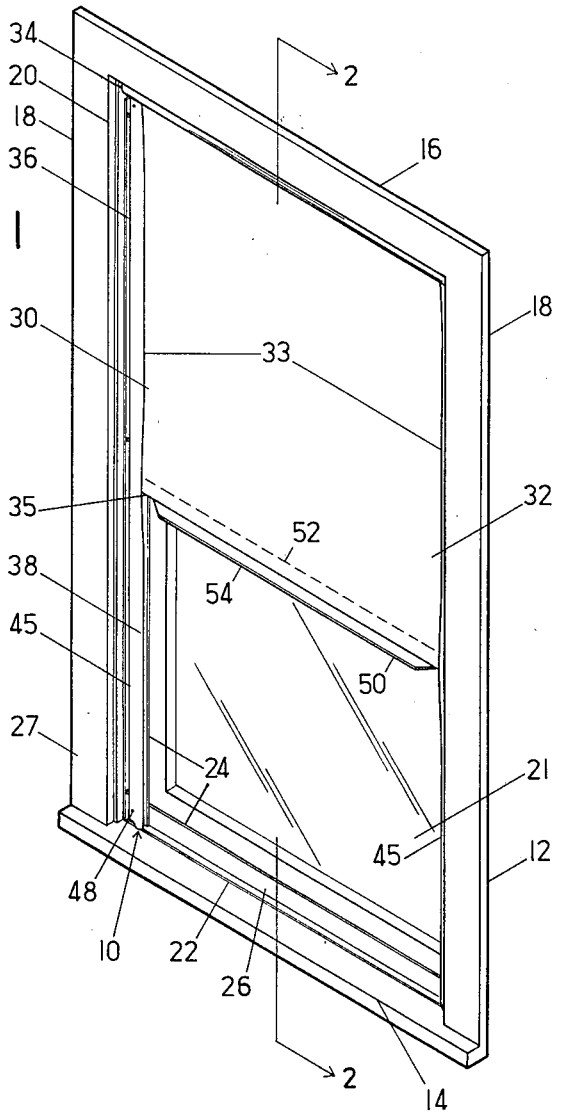
FIG. 1 is a perspective view of the window covering sealing structure of the invention, installed in a window and with a rollable window covering engaged therein.

Referring more particularly to the drawings, wherein like numbers refer to like parts, FIG. 1 illustrates the preferred embodiment of the window covering sealing structure of the invention, shown generally at 10, installed in a window frame 12 having a horizontally disposed sill 14, an upper head member 16 opposed to the sill, and opposed end jambs 18. Surfaces of the sill 14, upper head member 16, and opposed end jambs 18 define a window opening 20. The window opening 20 is closed by a glazed window 21.

A mounting flange 22 is attached to the sill 14, upper head member 16, and opposed end jambs 18, the mounting flange extending inwardly into the window opening 20 for a selected distance. Preferably, the mounting flange 22 includes four flange members 24, with one flange member attached to each of the sill 14, upper head member 16, and opposed end jambs 18. Corresponding surfaces of the flange members 24 combine to define substantially coplanar mounting surfaces 26 extending about all four sides of the frame 12. The window frame 12 and associated structures have an interior side 27 and an exterior side 28, and preferably the mounting surface 26 faces interiorly, although other orientations of the mounting surface are within the scope and spirit of the invention.

A rollable window covering 30 is mounted on the window frame 12 and is adapted to selectively close the window opening 20. The rollable window covering 30 includes a flexible covering member 32 having side edges 33 and a bottom edge 35. The flexible covering member 32 is adapted to be rolled on a substantially cylindrical roller 34. The roller 34 is mounted to selected surfaces of the frame 12 and is located adjacent to the upper head member 16. The flexible covering member 32 may be selectively lowered or raised, over the window opening 20 by any conventional means, the edges of the flexible covering member 32 being adjacent to the mounting surface 26 when the covering member is closed.

The window covering sealing structure 10 of the invention includes a strip 36 of flexible, resilient sheet material. The strip 36 may be made of vinyl, fabric, thin metal, or other suitable, flexible sheet material. If the strip is made of vinyl, it may be formed as an integral extrusion with the side mounting flanges 24 by a duometric extrusion process such that the mounting flanges are rigid while the strip is flexible. The strip 36 has a selected width, two faces, and longitudinally extending side edges. The strip 36 may be conveniently manufactured and shipped as a roll containing a convenient length of the strip 36 suitable for application to an indefinite number of windows. Suitable lengths of the strip 36 may then be cut from the roll to be used as disclosed below when an application of the window covering sealing structure 10 to a particular window is desired.

Figure 4:
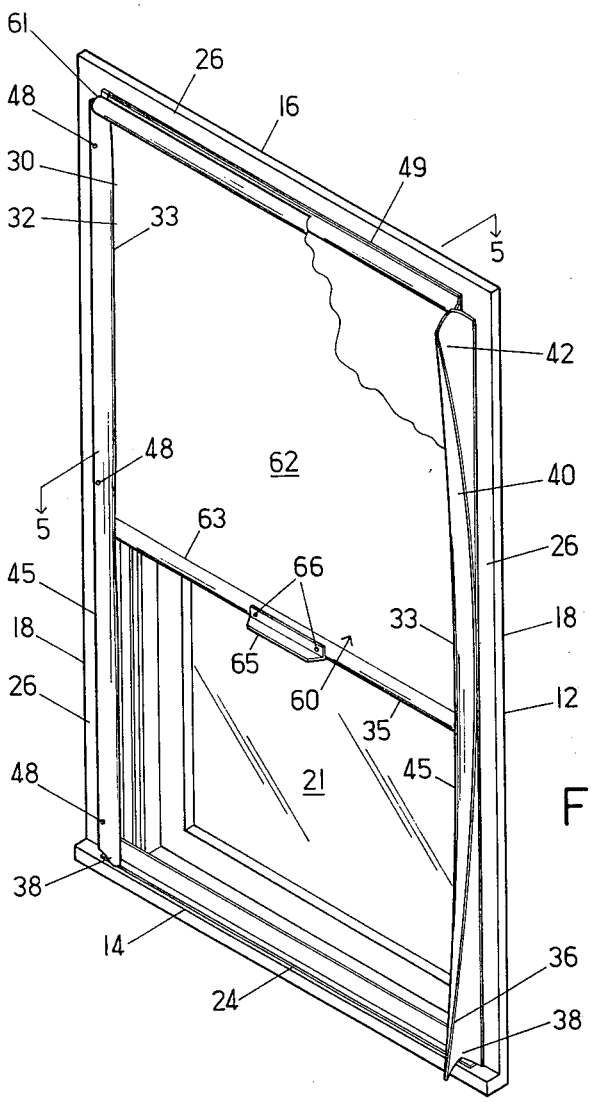
FIG. 4 is a perspective view of an alternative embodiment of the window covering sealing structure of the invention.
Figure 5:
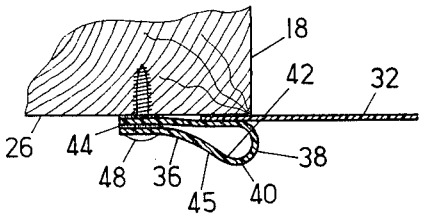
FIG. 5 is a section view of a broken away portion of the window covering sealing structure of FIG. 4, taken along section lines 5—5 of FIG. 4.

The strip 36 is adapted to be bent back on itself to form a longitudinally extending fold 38, as is best illustrated in FIGS. 4 and 5, which shows the installation of the window sealing structure 10 to the portion of the jamb or frame 18 surrounding the window. By this process, portions of a selected one of the two faces of the strip 36 are substantially opposed to other portions of the same face, so that, when the strip is in its folded configuration, one of the faces is an exposed, outwardly presented face 40 and the other is a concealed, inwardly presented face 42, as is best illustrated in FIG. 4.

The window covering sealing structure 10 of the invention includes means for retaining the strip 36 in the folded configuration described above. Preferably, a suitable pressure sensitive adhesive is applied to opposed portions of the concealed face 42, at a point remote from the fold 38 to allow the strip to be held together. A convenient means for sealing the strip together is a tape 44 applied between the folded strip 36, as shown in FIG. 5, which has adhesive applied to both sides thereof. However, direct application of pressure sensitive adhesive to the strip, and other means for retaining the strip 36 in a folded configurtion, such as Velcro fasteners, lie within the scope and spirit of the invention.

A length of folded strip 36 shall be referred to hereinafter as a "sealing strip." A pair of opposed, side sealing strips 45 having a length selected to extend parallel to the end jambs 18 from the sill 14 to the roller 34 are attached to the mounting surface 26 of the side flanges 24 and thence to the jambs 18 by a suitable means for fastening such structures together. The screws shown at 48 in FIGS. 1 and 4, rivets, or mastic are examples of such suitable means for fastening, but any other suitable fastening means lies within the scope and spirit of the invention. The means for fastening may also serve as the means for retaining the strip 36 in its folded configuration to form the side sealing strips 45. The side sealing strips 45 are fastened at points on the sealing strips remote from the fold 38 and are so located that the fold 38 of a sealing strip 45 overlaps each of the side edges 33 of the flexible covering member 32 when it is in its closed position, the fold extending over the edge for a selected distance.

A strip of resilient material folded in the manner described above to form a sealing strip will present a substantially symmetrical, teardrop shape when viewed in a cross section taken laterally to the longitudinal axis of the strip. When such a folded strip is fastened against a substantially flat surface, such as the mounting surface 26, the side of the folded strip adjacent to the surface partly conforms to that surface, and the teardrop shape is thereby deformed. For the strip to be deformed, a force sufficient to cause the deformation must be exerted by the surface against the strip, the magnitude of which force is dependent upon the resilience of the material from which the strip is made. Consequently, by selecting the resilience of that material, it is possible to select the tightness with which an object inserted between the deformed strip and the surface is held therebetween. As the flexible covering member 32 is lowered to cover the window opening 20, its vertical edges 33 extend between the side sealing strips 45 and the mounting surface 26 and are held therebetween with a selected amount of force. If, for example, the window covering is intended to reduce heat exchange through the window, the force is selected to be sufficient to substantially prevent the passage of air between the flexible covering member and either the mounting surface 26 or the side sealing strip 45. It will be appreciated that the side sealing strips 45 present no edges or sharp surfaces toward the flexible covering member 32, so that the covering member is protected from scratching or other mechanical damage.

By means of the window covering sealing structure 10, as disclosed above, the sides of a rollable window covering 30 may be sealed so as to prevent the passage of air, insects, or light around the edges of that covering. Often it is also desirable to seal the top of a rollable window covering 30 and the upper head member 16 of a window frame 12, for example to stop convection currents that might otherwise cause a mixing of the air on the interior side of the window covering 30 and the air between an airflow imprevious flexible covering member 32 and the glazed window 21. To accomplish this end, a length of sealing strip is selected to form a top seal 49 and is mounted on the mounting surface 26 of the flange member 24 that is attached to the upper head member 16, if flange members are in use, or to the selected interiorly facing surface of the head member 16, serving as a mounting surface 26, if no flange members are in use. The top seal 49 is selected to extend along the head member 16 substantially from one opposed end jamb 18 to the other, and to seal the space between the rollable window covering 30 and the upper head member 16. The width of the teardrop cross sectional shape of the top seal 49 is selected to be sufficient to fill the space between the roller 34 and the part of the mounting surface 26 that is associated with the upper head member 16. The top seal 49 is so located that it contacts both the surface of the flexible covering 32 wound on the roller 34 and the mounting surface 26 in sealing relation.

Figure 2:
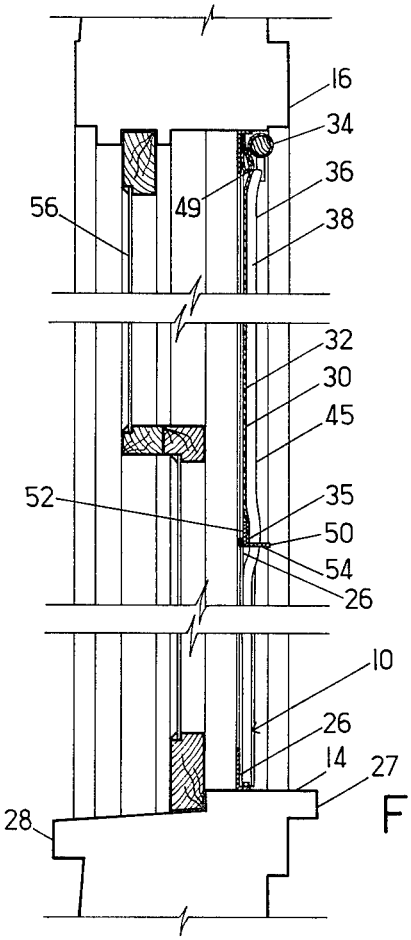
FIG. 2 is a section view of the window covering sealing structure shown in FIG. 1, taken along section lines 2—2 of FIG. 1.
Figure 3:
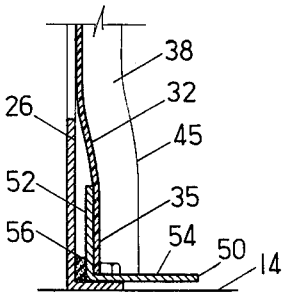
FIG. 3 is a section view of a broken away portion of the window covering sealing structure shown in FIG. 1, taken along the same section lines as is FIG. 2 but with the rollable window covering in a closed position.

Often it is also advisable that air, insects, light, or the like not be allowed to pass between the rollable window covering 30 and the sill 14 when the flexible covering member 32 has been drawn to close the window opening 20. To accomplish this end, a substantially rigid stiffener member 50 is attached to the bottom edge 35 of the flexible covering member 32 in the structure shown in FIGS. 1–3. The stiffener member 50 has a substantially flat back plate 52, shown in FIGS. 2 and 3, and shown in phantom by the dashed line labeled 52 in FIG. 1. The back plate 52 extends for substantially the full width of the flexible covering member 32 and extends upwardly behind the bottom edge 35 of the flexible covering member for a selected distance. The back plate 52 extends behind and is engaged by the side sealing strips 45. A handle 54 extends under the bottom edge 35 of the covering member 32 interiorly for a selected distance and provides a structure that may be grasped with the fingertips to aid in lowering and raising the flexible covering member 32. When flange members 24 are in use, a resilient sealing pad 56 is attached to a selected exteriorly facing surface of the back plate 52. When the stiffener member 50 has been lowered to the level of the sill 14, the resilient pad 56 is pressed against the mounting surface 26 of the flange member 24 attached to the sill 14 by force exerted on the stiffener member 50 by the side sealing strips 45 under which the ends of the stiffener member extend. In the embodiment of FIG. 1, the bottom flange member 24 may be omitted, if desired, since the shade will be pulled down adjacent the lower portion of the window 21, and the pad 56 can butt up directly against the bottom of the window to seal the joint between the window and window frame. By this means, the passage of convection currents and other airflow, insects, and light between the rollable window covering 30 and the sill 14 is substantially prevented.

It will be appreciated that by combined use of the means described above to seal the sides, top, and bottom of a rollable window covering 30 to the window frame 12, movement of air therebetween may be substantially prevented, effectively creating a dead air space between the rollable window covering 30 and the glazed window 21. This is of particular value when the flexible covering member 32 is made of a material having a desired transparency that may serve as a retractable storm window or, if partially silvered, as a radient energy barrier. In addition, the window covering sealing structure 10 prevents most insects from passing between the flexible covering member 32 and the frame 12, as may be especially desired when the flexible covering member is an insect screen. When the flexible covering member 32 is opaque, the use of an opaque material for the side sealing strips 45 and the top seal 49 will serve to more completely exclude light.

The strip 36 may be made with faces of different colors, for example with one a light color and the other a dark color. The user may then fold the strip 36 in the manner disclosed above, so as to have either the dark or the light face form the exposed, outwardly presented face 40. By this means, a single strip 36 may be adapted to harmonize in color with either dark or light colored woodwork.

An alternative assembly of the window shade sealing structure of the invention is shown in FIG. 4, which is adapted to seal a conventional cloth window shade 60. The window frame 12 shown in FIG. 4 is identical to that shown in FIG. 1. However, the conventional window shade 60—which includes a roller 61, a flexible fabric covering 62, and a hem 63 in the covering at the bottom of the shade forming a pocket which holds a wood stiffening slat (not shown)—is mounted to the sides 27 of the window frame which face the room interior rather than within the confines of the frame and adjacent the window as in the structure of FIG. 1. For this window shade placement the sealing strips 45 are mounted directly to the surface of the window frame, preferably with screws 48; and the side flanges 24 shown in FIG. 1 are not needed and are not used since the surface of the window frame itself provides the mounting surface 26.

A flange member 65 defining a handle is secured to the shade material 62 by adhesive and is attached to the wood slat at the bottom of the shade with screws 66. The flange shaped handle 65 allows the shade to be pulled by a user right down to the sill 14, and also allows the user to depress the shade slightly when it is down to release a spring loaded roller 61 when the user desires to raise the shade. A resilient pad 56 (not shown in FIG. 4) can be adhered to the back of the shade against the internal slat to enhance the bottom seal formed by the shade when it is pulled all the way down. A top seal 49 is mounted, as described above, in position to press against the shade material at the roller 61 to provide a seal at the top of the shade.

The assembly of FIG. 4 can also utilize the shade structure 30 of FIG. 1 rather than a conventional window shade.

It should be noted that many modern window structures do not have a sill which extends inwardly beyond the window frame. For such windows the bottom flange member 24 is not needed, since the bottom of the shade 62 can simply be pulled down over the bottom frame of the window so that the sealing pad 56 will engage the bottom frame.

The rigid parts that have been described above may be made from any suitable rigid material, such as wood, metal, or a suitable plastic forming techniques. The flexible covering member 32 may be selected from any flexible material having the air, light, or insect penetration qualities desired. An example of a suitable material is polyester (polyethylene terephthalate). The covering member 32 may be made reflective of infra red radiation by having a thin layer of metal deposited thereon.

It is understood that the invention is not confined to the particular materials and embodiments herein illustrated and described, but embraces all such modified forms thereof as come within the scope of the following claims.

What is claimed is:

1. A window covering sealing structure adapted to seal a rollable window covering having a flexible covering member with side edges to a window frame which includes inwardly facing opposite side mounting surfaces, comprising:

(a) a pair of strips each having two faces and a longitudinal axis and formed of flexible, resilient sheet material sufficiently flexible that each strip can be folded back on itself into a folded configuration having a longitudinally extending fold portion such that parts of a face are substantially opposed to other parts of the face and the face is concealed from view;

(b) means for holding together opposed portions of the concealed face to retain each strip in the folded configuration with a resilient, longitudinally extending fold portion; and (c) means for fastening the strips to the opposite side mounting surfaces at points on each strip remote from the fold portion with the fold portion of each strip adjacent to the mounting surface being deformed to partly conform to that surface so that the side edges of the covering will extend between the folded strips and the mounting surface and be held therebetween with a selected amount of force.

2. The window covering sealing structure of claim 1 wherein each face of each strip has a selected color differing from that of the other face, whereby a user of the strip may select one of the faces to be concealed, inwardly presented face and the other face to be an exposed, outwardly presented face when the strip is folded.

3. The window covering sealing structure of claim 1 in which the window frame includes a sill, opposed end jambs, and an upper head member, and surfaces of the sill, upper head member, and opposed end jambs define a window opening, and including mounting flanges attached to upper head member and opposed end jambs, the mounting flanges extending inwardly into the window opening for a selected distance; and wherein the inwardly facing mounting surfaces are defined by substantially coplanar surfaces of the mounting flanges.

4. The window covering sealing structure of claim 3 in which the rollable window covering has a roller from which the flexible covering member depends, the roller being mounted to the frame adjacent to the upper head member, and including a strip of flexible, resilient sheet material having two faces and a longitudinal axis and sufficiently flexible to be folded back on itself into a folded configuration having a longitudinally extending fold portion such that parts of a face are substantially opposed to other parts of the face and the face is concealed from view, the strip having a length selected to extend substantially from one opposed end jamb to the other to form a top seal, and including means for holding together opposed portions of the concealed face to retain the top seal strip in a folded configuration and means for fastening the top seal strip to a selected part of the mounting surface defined by the mounting flange attached to the upper head member at points on the top seal strip remote from the fold portion to fill the space between the roller and the mounting surface and contact the mounting surface and the roller in sealing relation.

5. The window covering sealing structure of claim 1 including a mounting flange attached to the sill in position to be engaged by the bottom of the covering member when it is drawn down.

6. The window covering sealing structure of claim 1 wherein the means for holding together opposed portions of the concealed face of each strip includes a selected mastic applied to opposed portions of the face at points remote from the fold portion.

7. The window covering sealing structure specified in claim 6 wherein the mastic includes a tape having two, opposite sides, and having adhesive applied to each side.

8. The window covering sealing structure specified in claim 1 wherein the means for fastening each strip to the mounting surface includes selected fasteners adapted to penetrate the strip when it is in its folded configuration at points remote from the fold portion and to engage the mounting surface in fastening relation, the means for fastening the strip thereby also serving to hold opposed portions of the concealed face together and to retain the strip in the folded configuration.

9. The window covering sealing structure specified in claim 1 or claim 8 wherein the means for fastening the strip to the mounting surface includes a plurality of screws adapted to engage the mounting surface in threaded relation.

10. The window covering sealing structure specified in claim 1 in which the flexible covering member has a bottom edge and two side edges, each side edge adapted to be engaged by a side sealing strip, and the window frame has a sill, and including a stiffener member attached to the bottom edge and extending substantially parallel to the sill, the stiffener member extending between the side sealing strips and the mounting surface, whereby the stiffener member is held against the mounting surface with a selected force; and a resilient sealing pad attached to the stiffener member and adapted to rest in sealing relation against a selected surface of the sill.

11. The window covering sealing structure specified in claim 10 in which a flange member is attached to the sill, and the selected surface of the sill against which the resilient sealing pad rests in sealing relation is a selected surface of the flange member that is coplanar with the mounting surface, whereby the force exerted by the side sealing strips on the stiffener member biases the resilient sealing pad against the flange member.

12. The window covering sealing structure specified in claim 10 or 11 in which the stiffener member has a substantially flat back plate which extends for substantially the full width of the flexible covering member and extends upwardly from the bottom edge for a selected distance, the back plate extending between the side sealing strips and the mounting surface; and a handle that extends interiorly from the bottom edge for a selected distance.

13. A window covering sealing structure adapted to close a window opening having a window frame, selected surfaces of which define a mounting surface, comprising:

(a) a rollable window covering having a roller from which a flexible covering member depends, the flexible covering member having side edges, the roller being mounted in turning relation to a selected part of the frame so that the flexible covering member may be lowered to cover the window opening;

(b) a pair of strips each having two faces and a longitudinal axis and formed of flexible, resilient sheet material sufficiently flexible that each strip can be folded back on itself into a folded configuration having a longitudinally extending fold portion such that parts of a face are substantially opposed to other parts of the face and the face is concealed from view;

(c) means for holding together opposed portions of the concealed face to retain each strip in a folded configuration with a resilient, longitudinally extending fold portion; and (d) means for fastening the strips to the opposite side mounting surfaces of the window frame at points on each strip remote from the fold portion with the fold portion of each strip adjacent to the mounting surface being deformed to partly conform to that surface so that the side edges of the covering will extend between the folded strips and the mounting surface and be held therebetween with a selected amount of force.

14. The window covering sealing structure of claim 13 wherein each face of each strip has a selected color differing from that of the other face, whereby a user of the strip may select one of the faces to be a concealed, inwardly presented face and the other face to be an exposed, outwardly presented face when the strip is folded.

15. The window covering sealing structure of claim 13 wherein the window frame has an interior side, opposed end jambs, and an upper head member, and in which the mounting surface is defined by selected, coplanar, interiorly facing surfaces; and wherein the roller is mounted to the window frame adjacent to the upper head member; and further including a strip of flexible, resilient sheet material having two faces and a longitudinal axis and sufficiently flexible to be folded back on itself into a folded configuration having a longitudinally extending fold portion such that parts of a face are substantially opposed to other parts of the face and the face is concealed from view, the strip having a length selected to extend substantially from one opposed end jamb to the other to form a top seal, and means for holding together opposed portions of the concealed face to retain the strip in a folded configuration, and means for fastening the top seal strip to a selected part of the top mounting surface of the window frame at positions on the top seal strip remote from the fold portion to fill the space between the roller and the mounting surface and contact the mounting surface and the roller in sealing relation.

16. The window covering sealing structure specified in claim 13 wherein the flexible covering member has a bottom edge and two side edges, each side edge adapted to be engaged under a side sealing strip located adjacent thereto, and the window frame has a sill, and including a stiffener member attached to the bottom edge of the covering and extending substantially parallel to the sill, the stiffener member extending between the side sealing strips and the mounting surface, whereby the stiffener member is held against the mounting surface with a selected force; and a resilient sealing pad attached to the stiffener member and adapted to rest in sealing relation against a selected surface of the sill.

17. The window covering sealing structure of claim 13 wherein the window covering is made of polyester and has a surface metalized to reflect infrared radiation.

18. A window covering sealing structure adapted to close a window opening having a window frame which includes a sill, opposed end jambs, and an upper head member, surfaces of the sill, upper head member and opposed end jambs defining a window opening, comprising:

(a) mounting flanges attached to the opposed end jambs, the mounting flanges extending inwardly into the window opening for a selected distance, the mounting flanges having substantially coplanar surfaces extending inwardly into the window opening defining inwardly facing mounting surfaces;

(b) a rollable window covering having a roller from which a flexible covering member depends, the flexible covering member having side edges, the roller being mounted in turning relation to a selected part of the window frame so that the flexible covering member may be lowered to cover the window opening;

(c) a pair of strips each having two faces and a longitudinal axis and formed of flexible, resilient sheet material sufficiently flexible that each strip can be folded back on itself into a folded configuration having a longitudinally extending fold portion such that parts of a face are substantially opposed to other parts of the face and the face is concealed from view;

(d) means for holding together opposed portions of the concealed face to retain each strip in a folded configuration with a resilient, longitudinally extending fold portion; and (e) means for fastening the strips to the opposite side mounting surfaces of the flanges at points on each strip remote from the fold portion with the fold portion of each strip adjacent to the mounting surface being deformed to partly conform to that surface so that the side edges of the covering will extend between the folded strips and the mounting surface and be held therebetween with a selected amount of force.

19. The window covering sealing structure of claim 18 including:

a mounting flange attached to the upper head member and extending inwardly into the window opening to define an inwardly facing mounting surface;

a strip of flexible, resilient sheet material having two faces and a longitudinal axis and sufficiently flexible to be folded back on itself into a folded configuration having a longitudinally extending fold portion such that parts of a face are substantially opposed to other parts of the face and the face is concealed from view, the strip having a length selected to extend substantially from one opposed end jamb to the other to form a top seal;

means for holding together opposed portions of the concealed face to retain the top seal strip in a folded configuration; and means for fastening the top seal strip to a selected part of a mounting surface defined by the mounting flange attached to the upper head member at points on the top seal strip remote from the fold portion to fill the space between the roller and the mounting surface and contact the mounting surface and the roller in sealing relation.

20. The window covering sealing structure of claim 18 including a mounting flange attached to the sill in position to be engaged by the bottom of the covering member when it is drawn down.

21. The window covering sealing structure of claim 18 wherein the means for holding together opposed portions of the concealed face of each strip includes a selected mastic applied to opposed portions of the face at points remote from the fold portion.

22. The window covering sealing structure of claim 21 wherein the mastic includes a tape having two opposite sides, and having adhesive applied to each side.

23. The window covering sealing structure of claim 18 wherein the means for fastening each strip to the mounting surface includes selected fasteners adapted to penetrate the strip when it is in its folded configuration at points remote from the fold portion and to engage the mounting surfaces of the mounting flanges in fastening relation, the means for fastening the strip thereby also serving to hold opposed portions of the concealed face together and to retain the strips in the folded configuration.

* * * * *